US008376422B2

(12) United States Patent
Swink

(10) Patent No.: US 8,376,422 B2
(45) Date of Patent: Feb. 19, 2013

(54) DOOR LATCH ASSEMBLY AND METHODS OF USE THEREOF

(76) Inventor: Kerry Swink, Oklahoma City, OK (US)

( * ) Notice: Subject to any disclaimer, the term of this patent is extended or adjusted under 35 U.S.C. 154(b) by 662 days.

(21) Appl. No.: 12/553,562

(22) Filed: Sep. 3, 2009

(65) Prior Publication Data

US 2010/0060020 A1 Mar. 11, 2010

Related U.S. Application Data

(60) Provisional application No. 61/094,587, filed on Sep. 5, 2008.

(51) Int. Cl.

| | |
|---|---|
| ***E05C 17/04*** | (2006.01) |
| ***E05C 19/18*** | (2006.01) |
| ***E05C 19/00*** | (2006.01) |
| ***E05B 15/02*** | (2006.01) |
| ***E05F 5/02*** | (2006.01) |

(52) U.S. Cl. ..... 292/278; 292/262; 292/340; 292/288; 292/304; 16/82

(58) Field of Classification Search ..... 292/338, 292/339, 340, 341, 341.17, 341.18, 342, 292/343, 262, 278, 285, 288–298, 300, 304, 292/341.15, DIG. 15, DIG. 17; 16/82, 83; 49/381, 383, 460

See application file for complete search history.

(56) References Cited

U.S. PATENT DOCUMENTS

| | | | | | |
|---|---|---|---|---|---|
| 1,532,737 | A | * | 4/1925 | Dohrmann | 292/278 |
| 1,938,342 | A | * | 12/1933 | Levine | 292/87 |
| 2,174,890 | A | * | 10/1939 | Lipiner | 70/93 |
| 2,396,982 | A | * | 3/1946 | Bousquet | 292/289 |
| 2,407,900 | A | * | 9/1946 | Paul | 70/93 |
| 2,772,110 | A | * | 11/1956 | Petrochko | 292/341.17 |
| 3,924,886 | A | * | 12/1975 | Markovitch | 292/263 |
| 4,254,976 | A | * | 3/1981 | Shoberg | 292/292 |
| 4,391,463 | A | * | 7/1983 | Costa Bastart | 292/263 |
| 4,580,820 | A | * | 4/1986 | Baber | 292/264 |
| 4,589,692 | A | * | 5/1986 | Boyd | 292/297 |
| 4,711,479 | A | * | 12/1987 | Grandinetti | 292/272 |
| 4,770,451 | A | * | 9/1988 | Souza | 292/289 |
| 5,605,365 | A | * | 2/1997 | George | 292/263 |
| 5,771,720 | A | * | 6/1998 | Levenson | 70/93 |
| 5,836,626 | A | * | 11/1998 | Coy | 292/292 |
| 6,007,115 | A | * | 12/1999 | Roth | 292/71 |
| 6,145,351 | A | * | 11/2000 | Levenson | 70/93 |
| 6,454,320 | B1 | * | 9/2002 | Weinerman et al. | 292/56 |
| 6,520,551 | B1 | * | 2/2003 | Crnkovich | 292/288 |
| 6,926,316 | B2 | * | 8/2005 | Patire et al. | 292/290 |
| 6,957,836 | B1 | * | 10/2005 | Briley et al. | 292/129 |
| 6,976,716 | B2 | * | 12/2005 | Lin | 292/288 |
| 7,452,011 | B1 | * | 11/2008 | Lind | 292/87 |
| 2006/0214435 | A1 | * | 9/2006 | Swink | 292/262 |

* cited by examiner

*Primary Examiner* — Thomas Beach
*Assistant Examiner* — Nathan Cumar
(74) *Attorney, Agent, or Firm* — Hall Estill Law Firm

(57) ABSTRACT

A door latch assembly is attachable to a door jamb. The door latch assembly includes a base member and an extension member. The base member is mountable to the door jamb. The extension member is connectable to the base member such that the extension member extends from the base member. The extension member has a door stop member and a latch cup member. The door stop member is disposed substantially perpendicular to the latch cup member so that the door stop member provides a support for the door and the latch cup member receives a latch of the door so that the door is maintained in an ajar position.

20 Claims, 5 Drawing Sheets

DOOR LATCH ASSEMBLY AND METHODS OF USE THEREOF

CROSS-REFERENCE TO RELATED APPLICATIONS

The present application claims the benefit under 35 U.S.C. §119(e) of U.S. Provisional Application Ser. No. 61/094,587, filed Sep. 5, 2008, which is hereby expressly incorporated by reference herein in its entirety.

STATEMENT REGARDING FEDERALLY SPONSORED RESEARCH OR DEVELOPMENT

Not applicable.

BACKGROUND OF THE INVENTION

1. Field of the Invention

The present invention relates generally to door latches, and more particularly, not by way of limitation, to an improved door latch assembly for maintaining a door in an ajar position and a closed position.

2. Brief Description of the Prior Art

Structures for maintaining a door ajar are well known in the art. In a typical home, rooms may become colder in winter and hotter in summer due in part to poor air circulation. To counter poor air circulation and to maintain the exclusion of pets and small children from a room, a door structure can be used to maintain a door in an ajar position.

To this end, although door latch structures of the existing art are operable, further improvements are desirable to enhance the use of a door latch assembly which functions to maintain a door in a fixed ajar position. It is to such a door latch assembly that the present invention is directed.

DETAILED DESCRIPTION OF THE INVENTION

Figure 1:
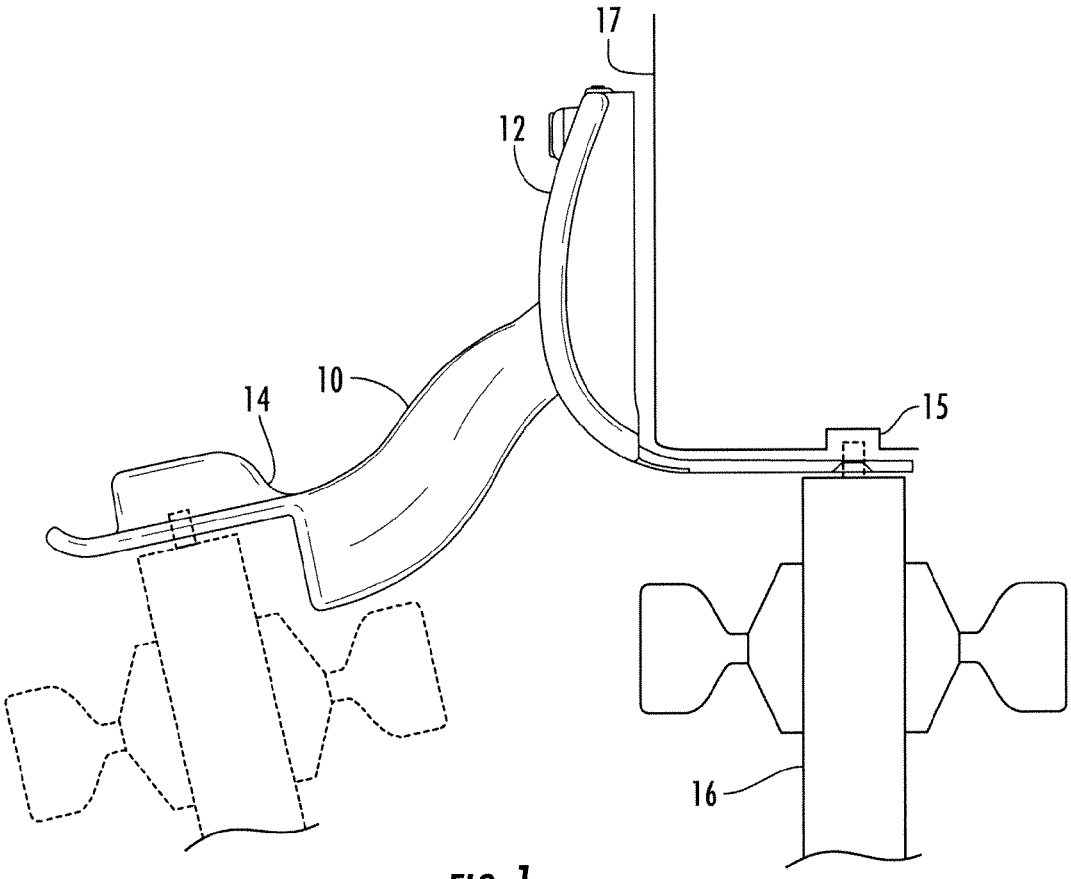
FIG. 1 is a top plan view of a door latch assembly constructed in accordance with the present invention, partially in cross-section wherein the door latch assembly engages a conventional door in a connectable position and an extended position.
Figure 2:
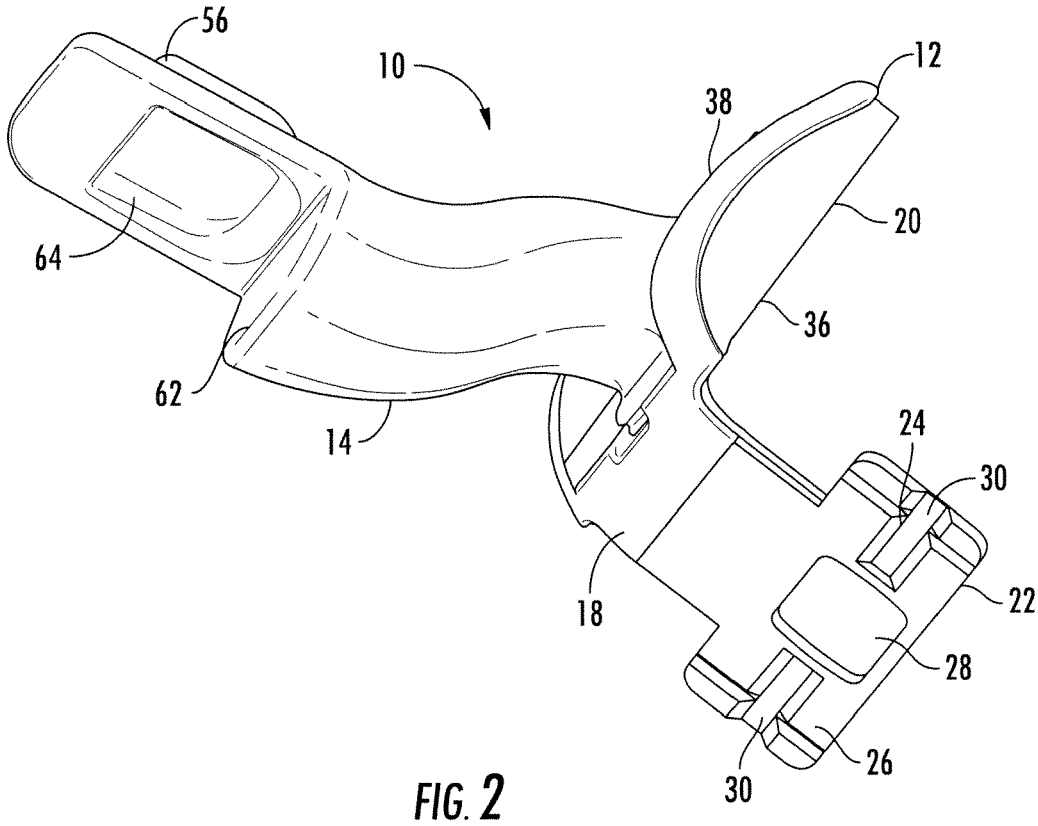
FIG. 2 is a perspective view of the door latch assembly of FIG. 1.
Figure 3:
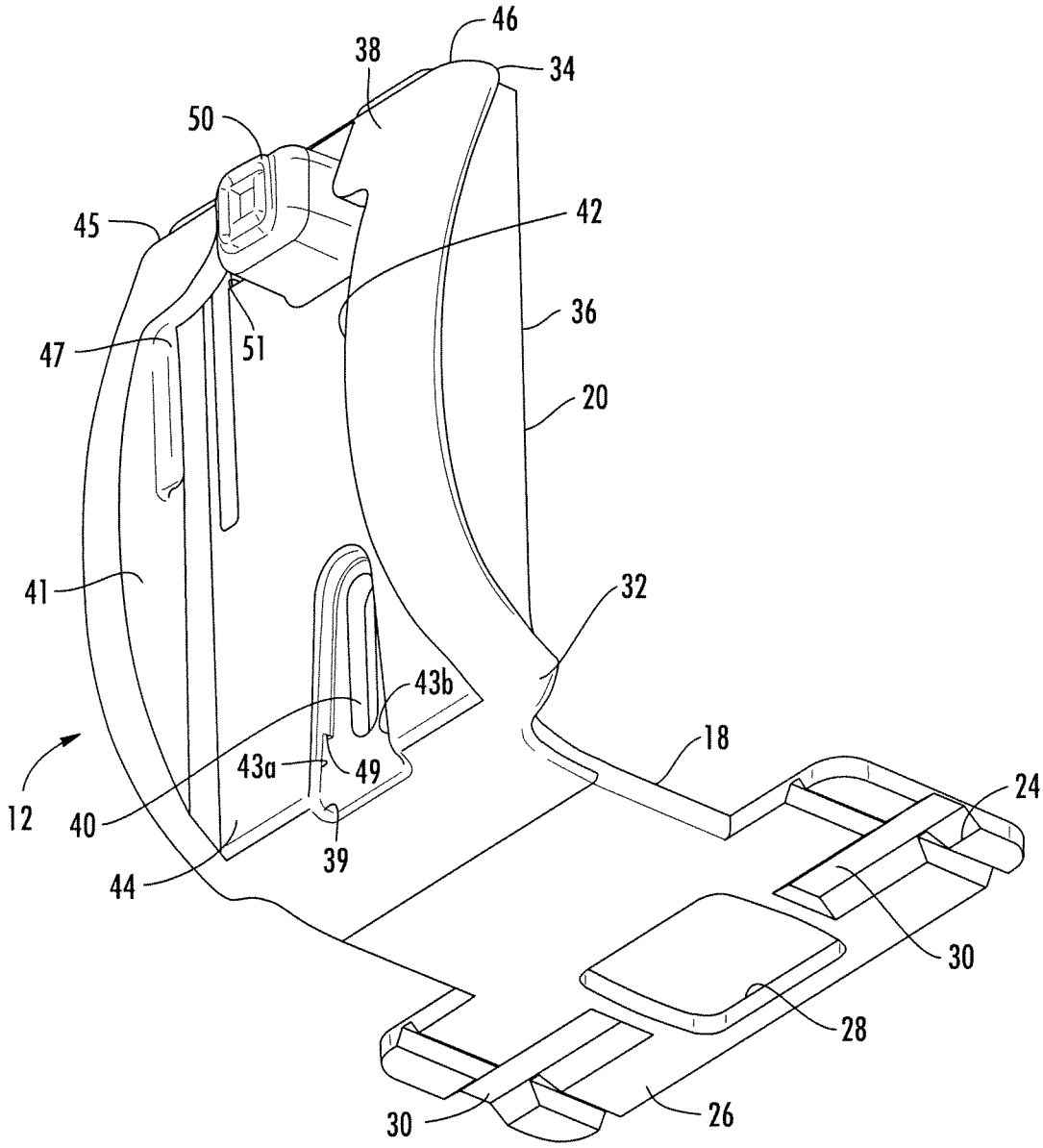
FIG. 3 is a perspective view a base member of the door latch assembly of FIG. 1.
Figure 4:
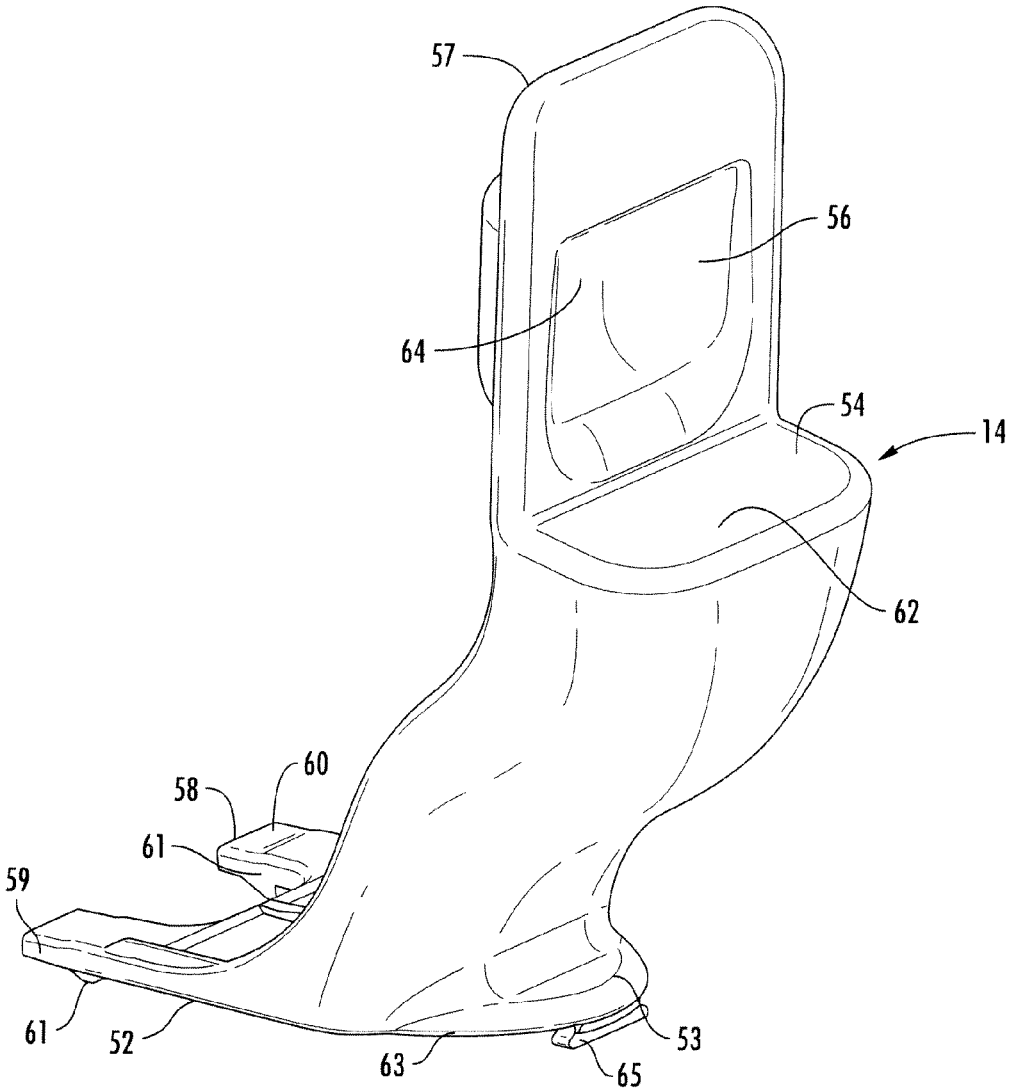
FIG. 4 is a perspective view of an extension member of the door latch assembly of FIG. 1.
Figure 5:
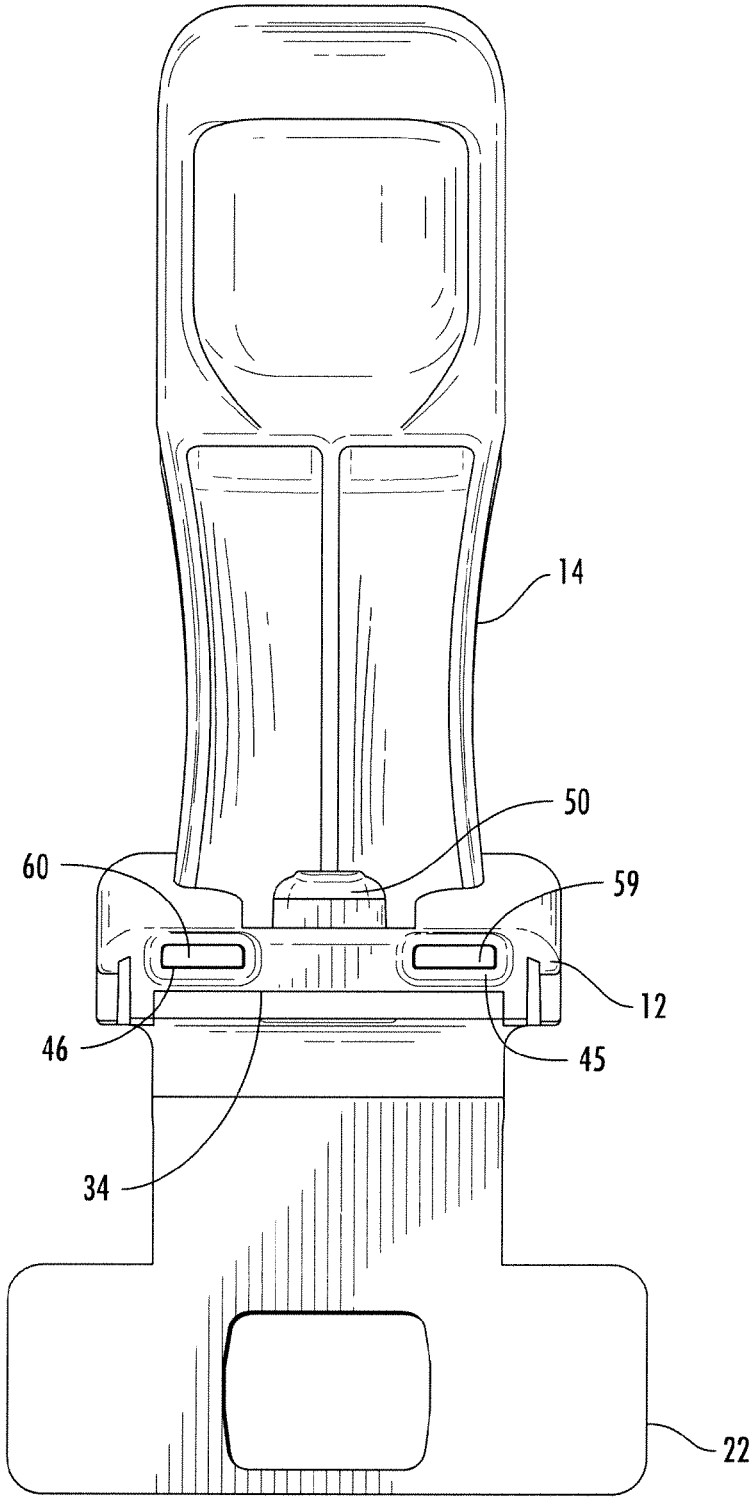
FIG. 5 is an elevational view of an extension member connected to a base member of the door latch assembly of FIG. 1.

Referring now to the drawings, and more particularly to FIG. 1, shown therein is a door latch assembly 10 constructed in accordance with the present invention. Broadly, the door latch assembly 10 includes a base member 12 and an extension member 14. The door latch assembly 10 is capable of being attached to a conventional door jamb 15. A conventional striker plate (not shown) is positioned on the door jamb 15. Preferably, the door jamb 15 is for an interior door 16, rather than an exterior door. However, it should be understood by one of ordinary skill in the art that a door jamb for an exterior door may be utilized with the door latch extension 10 in accordance with the present invention. The interior door 16, hereinafter referred to also as a door 16, is positioned within a door frame (not shown) having a door trim and the door frame is positioned within an interior wall 17 in a conventional manner. The door 16 is a conventional door including an exterior side, an interior side, and a door jamb end. The door 16 is provided with a latch and a door knob.

It is contemplated that the door latch assembly 10 is constructed from two pieces of material, however, it should be understood that the door latch assembly 10 may be constructed from various components or from one solid piece of material. The door latch assembly 10 is preferably made of a durable and rigid material which is strong enough to prevent movement and bending of the door latch assembly 10. Suitable materials for construction of the door latch assembly 10 and components thereof include polymeric materials, plastics, metals such as aluminum, steel, titanium, magnesium or alloys containing these metals, and composite materials which are capable of providing the desired strength and durability for the door latch assembly 10.

Referring now to FIGS. 1-3 and 5, the base member 12 includes a first leg 18 and a second leg 20. The first leg 18 of the base member 12 is substantially perpendicular to the second leg 20 of the base member 12 so that the base member 12 is provided with a substantially L-shaped configuration. However, it should be understood that the base member 12 may be configured in a variety of ways as long as the base member 12 functions in accordance with the present invention.

The first leg 18 of the base member 12 is provided with a striker plate portion 22. The striker plate portion 22 is provided with a pair of connector members 24 and 26 positioned on vertically opposing sides of an opening 28. The opening 28 is sized and dimensioned to receive a door latch. Each of the connector members 24 and 26 of the striker plate portion 22 are provided with an indentation 30 so as to adapt the striker plate portion 22 to the size of any conventional striker plate. The striker plate portion 22 effectively replaces a conventional striker plate. It is well known in the art that there are various sizes of striker plates used in different sized door jambs. The indentation 30 substantially extends vertically along the connector members 24 and 26 to adapt to various sized striker plates such that a screw may penetrate each of the connector members 24 and 26. A screw is used to connect each of the connector members 24 and 26 of the striker plate portion 22 to a door jamb. Additionally, the connector members 24 and 26 may include a longer portion of material so as to adapt to various sized striker plates, thus a portion of the connector members 24 and 26 may be trimmed off to compensate for various sizes of conventional striker plates. It should be understood that connectors are well know in the art and include various means for connecting one element to another.

In one embodiment, the first leg 18 of the base member 12 is mounted to a door jamb by the striker plate portion 22 by removing a conventional striker plate from the door jamb and replacing the conventional striker plate with the striker plate portion 22. Although the striker plate portion 22 is shown as a unitary portion of the base member 12, it should be understood that the striker plate portion 22 may be provided as a separate component from the base member 12 so long as the striker plate portion 22 functions in a manner as described herein.

The second leg 20 of the base member 12 includes a first end 32, a second end 34, an inner surface 36 and an outer surface 38. The second leg 20 extends about a door frame (not shown). The inner surface 36 of the second leg 20 of the base member 12 is capable of being positioned to allow for a secure fit between the second leg 20 of the base member 12 and a wall when the base member 12 is positioned against a wall.

A slot 39 is provided proximate the first end 32 of the second leg 20 of the base member 12. The slot 39 is configured so as to provide a pair of spaced apart tracks 43*a* and 43*b*. The end of the tracks 43 and 43*b* cooperate to provide a seat which is defined by a shoulder 49. An opening 40 is provided in the slot 39 such that a screw may be inserted to provide additional support for the base member 12 when being mounted about the door frame.

The outer surface 38 of the second leg 20 is provided with a first side member 41 and second side member 42. The first side member 41 and the second side member 42 are positioned in a spaced apart vertical relationship so as to form a channel 44 extending substantially between the first end 32 and the second end 34 of the second leg 20 for receiving the extension member 14. The second end 34 of the second leg 20 is provided with a pair of openings 45 and 46 and a pair of spaced apart tracks 47 and 48 (not shown) for providing additional support to the door latch assembly 10. A button 50 is also provided proximate the second end 34 of the second leg 20 of the base member 12 which will be discussed in more detail hereinafter. An opening 51 is provided which is positioned about the button 50.

Referring now to FIGS. 1, 2, 4 and 5, the extension member 14 of the door latch assembly 10 is provided with a substantially angled configuration to assist in the correct alignment of the door and for holding a door in an ajar position. The extension member 14 may be provided in a variety of lengths, such as 2 inches, 4 inches, 6 inches, etc., depending on the size of the door and the desire of an individual when holding a door ajar. The extension member 14 includes a locking member 52 at one end 53 and a door stop member 54 and a latch cup member 56 at the opposite end 57. The locking member 52 is provided with one end 58 that includes a first support member 59 and a second support member 60 in a substantially spaced apart unshaped configuration. Each support member 59 and 60 is provided with a tooth 61.

The other end 63 of the locking member 52 includes a key 65. The slot 39 of the base member 12 is configured to receive the key 65. A portion of the key 65 is configured to engage the tracks 43*a* and 43*b* of the slot 39.

The door stop member 54 extends substantially perpendicular from the latch cup member 56. The door stop member 54 includes a surface 62 for receiving a door.

The latch cup member 56 is provided with a latch retaining space 64 for receiving a latch of a door when the door is moved into the ajar position. The latch retaining space 64 is configured so as to be capable of receiving various sizes of door latches.

Referring now to FIGS. 1-5, the extension member 14 of the door latch assembly 10 is removably connectable to the base member 12. In the connected position, the locking member 52 of the extension member 14 is matingly received by the channel 44 of the base member 12. The first support member 59 and the second support member 60 are guided by tracks 47 and 48 such that each of the support member 59 and 60 are positioned into and extended through the openings 45 and 46, respectively, and the teeth 61 provided on the first support member 59 and the second support member 60 are positioned into the opening 51 thus locking the extension member 14 in an extended position so that a door may be held ajar. Further, the key 65 is inserted into the slot 39 and along the tracks 43*a* and 43*b* until the key 65 abuts the seat 49 of the slot 39 to provide additional support to the extension member 14 in the connected position. By applying a force to the button 50, the teeth 61 on the first support member 59 and the second support member 60 are released from the opening 51 and the extension member 14 is selectively removed from the channel 44 of the base member 12 in a first direction away from the button 50 so that a door may be closed.

In use, the door latch assembly 10 is attached to a door jamb 15. To attach the door latch assembly 10 to the door jamb 15, the conventional door striker plate (if present) is removed. The striker plate portion 22 of the base member 12 of the door latch assembly 10 is attached to the door jamb 15. The inner surface 36 of the second leg 20 of the base member 12 is positioned against the door trim or a wall to allow for a snug fit between the second leg 20 of the base member 12 and the wall 17. The locking member 52 of the extension member 14 is matingly received by the base member 12. The door 16 engages the surface 62 of the door stop 54 and the latch of the door 16 is received by the latch receiving space 64 of the latch cup member 56 and the door 16 is maintained in the ajar position.

The door latch assembly 10 is economical and easily installed. A door may be left ajar with the door latch assembly 10 allowing better air circulation for a room, while preventing animals or small children to transit through the door way. Another advantage of the door latch assembly 10 also allows children to be better heard when confined to a room than with the door completely closed and can prevent animal contact with small children when desired.

When not in use, the extension member 14 may be removed from the channel 44 and stored in a safe location to allow for a door to function normally. The door latch assembly 10 can be easily installed to replace the common door striker plate on both right hand and left hand doors. At all times a door knob will function normally.

In other embodiments, the various parts of the door latch assembly 10 are constructed from glow in the dark materials to prevent inadvertent contact at night by an individual. Optional attachments to the door latch assembly 10 may be included for placing car keys, wallets, change, etc. A night light may be provided to illuminate the door latch assembly 10. Additionally, an alarm may be provided to alert one of the opening of a door.

From the above description, it is clear that the present invention is well adapted to carry out the objectives and to attain the advantages mentioned herein as well as those inherent in the invention. While presently preferred embodiments of the invention have been described for purposes of this disclosure, it will be understood that numerous changes may be made which will readily suggest themselves to those skilled in the art and which are accomplished within the spirit of the invention disclosed.

What is claimed is:

1. A door latch assembly attachable to a door jamb, the door latch assembly comprising:

a base member mountable to the door jamb, the base member having at least one track and at least one opening; and an extension member removably connectable to the base member, the extension member having at least one support member received by the at least one track and the at least one opening of the base member to provide support such that the extension member extends from the base member, the extension member having a door stop member and a latch cup member, the door stop member disposed substantially perpendicular to the latch cup member so that the door stop member provides a support for the door and the latch cup member receives a latch of the door so that the door is maintained in an ajar position.

2. The door latch assembly of claim 1 wherein the base member has a striker plate portion that effectively replace a conventional striker plate.

3. The door latch assembly of claim 2 wherein the striker plate portion has at least one connector member provided with an indentation so as to adapt the striker plate portion to the size of any conventional striker plate.

4. The door latch assembly of claim 1 wherein a portion of the base member is configured for receiving a portion of the extension member such that the base member is connected to the extension member.

5. The door latch assembly of claim 1 wherein the base member has a slot for receiving a key of the extension member so as to provide support to the extension member when connected to the base member.

6. The door latch assembly of claim 1 wherein the door stop member of the extension member has a surface for receiving the door.

7. The door latch assembly of claim 1 wherein the at least one support member is positioned opposite the door stop member such that the at least one support member cooperates with the base member for locking the extension member in an extended position.

8. The door latch assembly of claim 1 wherein the base member is provided with a first side member and a second side member such the first and second side members are positioned in a spaced apart relationship for forming a channel and wherein the extension member has a locking member which is matingly received by a portion of the channel so as to lock the extension member in an extended position to secure the door in the ajar position.

9. The door latch assembly of claim 8 wherein a portion of the base member of the door latch assembly has a button for unlocking the extension member from the base member such that the extension member is selectively removed from the channel of the base member.

10. The door latch assembly of claim 1 wherein the extension member has a pair of support members positioned in a pair of openings of the base member so as to connect the extension member to the base member.

11. The door latch assembly of claim 10 wherein each of the support members is provided with a tooth for inserting into an opening of the base member for connecting the extension member to the base member.

12. A method for maintaining a door in an ajar position, comprising the steps of:

providing a door latch assembly, comprising:

a base member mountable to the door jamb, the base member having at least one track and at least one opening; and an extension member removably connectable to the base member, the extension member having at least one support member received by the at least one track and the at least one opening of the base member for providing support such that the extension member extends from the base member, the extension member having a door stop member and a latch cup member, the door stop member disposed substantially perpendicular to the latch cup member;

installing the base member to the door jamb;

connecting the extension member to the base member by positioning the at least one support member along the track of the base member and into the at least one opening of the base member so as to provide a support surface for the door in the ajar position;

selectively moving the door into the ajar position so that the door is supported on the door stop member; and positioning the door latch in the retaining space of the latch cup member so that the latch cup member cooperates with the door stop member to latch the door in the ajar position.

13. The method of claim 12 further comprising the step of:

selectively removing the extension member from the base member.

14. The method of claim 12 wherein the base member has a striker plate portion attachable to a conventional striker plate.

15. The method of claim 14 wherein the striker plate portion has at least one connector member provided with an indentation so as to adapt the striker plate portion to the size of any conventional striker plate so that a screw may penetrate the at least one connector member and connect the at least one connector member to the door jamb.

16. The method of claim 12 wherein a portion of the base member is configured for receiving a portion of the extension member such that the base member is connected to the extension member.

17. The method of claim 12 wherein the at least one support member is positioned opposite the door stop member such that the at least one support member cooperates with the base member for locking the extension member in an extended position.

18. The method of claim 12 wherein the base member is provided with a first side member and a second side member such the first and second side members are positioned in a spaced apart relationship for forming a channel and wherein the extension member has a locking member which is matingly received by a portion of the channel so as to lock the extension member in an extended position to secure the door in the ajar position.

19. The method of claim 18 wherein a portion of the base member of the door latch assembly has a button for unlocking the extension member from the base member such that the extension member is selectively removed from the channel of the base member.

20. The method of claim 18 wherein the base member has a slot for receiving a key of the extension member so as to provide additional support to the door latch assembly.

* * * * *